US005416500A

United States Patent [19]

Tohdo

[11] Patent Number: 5,416,500

[45] Date of Patent: May 16, 1995

[54] METHOD AND APPARATUS FOR HIGH PRECISION THERMAL PRINTING APPLICABLE TO VARIETY OF PRINTING TARGETS

[75] Inventor: Michiharu Tohdo, Kawasaki, Japan

[73] Assignee: Keisouku Industry Co., Ltd., Tokyo, Japan

[21] Appl. No.: 78,033

[22] Filed: Jun. 18, 1993

[30] Foreign Application Priority Data

Jun. 19, 1992 [JP] Japan ..... 4-161153

[51] Int. Cl.[6] ..... B41J 2/325

[52] U.S. Cl. ..... 347/171; 400/120

[58] Field of Search ..... 346/1.1, 76 PH; 400/120

[56] References Cited

U.S. PATENT DOCUMENTS 4,504,837 3/1985 Toyoda et al. ..... 346/1.1

5,053,788 10/1991 Tohdo ..... 346/1.1

FOREIGN PATENT DOCUMENTS 0214666 12/1984 Japan ..... 400/120

0151360 7/1987 Japan ..... 346/76 PH

*Primary Examiner*—Huan H. Tran

*Attorney, Agent, or Firm*—Burns, Doane, Swecker & Mathis

[57] ABSTRACT

A high precision thermal printing capable of thermally printing diverse patterns on variety of printing targets having not necessarily flat printing surfaces, stably and efficiently, at a very high precision. In this thermal printing, a first film for carrying a thermally transferrable applied material and a second film for receiving the applied material thermally transferred from the first film are provided. Then, a desired printing pattern is formed on the second film by applying heat to a desired part of the applied material on the first film in a shape of the desired printing pattern, and the desired printing pattern formed on the second film is then thermally transferred to a printing target.

20 Claims, 4 Drawing Sheets

METHOD AND APPARATUS FOR HIGH PRECISION THERMAL PRINTING APPLICABLE TO VARIETY OF PRINTING TARGETS

BACKGROUND OF THE INVENTION

1. Field of the Invention

The present invention relates to a method and an apparatus for thermal printing on a printing target such as a cardboard, wood, concrete, or steel sheet constituting a part of a box or a container.

2. Description of the Background Art

In general, as a method of printing a limited number of patterns onto a large number of printing targets, there has been a method using a stamp printer.

However, in such a conventional method using a stamp printer, there arises a need to temporarily stop the printing process in order to manually change the stamp in accordance with the desired printing patterns, so that the work required for operating a conventional stamp printer can be quite tedious as well as inefficient. In addition, in order to operate such a conventional stamp printer, there is also a need to secure a rather large storage space for stocking a large number of different stamps to be used in the stamp printer, so that the conventional method using a stamp printer has also been ineconomical in that respect.

Moreover, in such a conventional method using a stamp printer, there is a need to make test printings for at least several times, every time the stamp is changed to a new one, in order to secure a uniform spread of the ink on the stamp as well as for adjusting a positioning of the stamp, so that the conventional method using a stamp printer has been ineconomical in that respect as well.

On the other hand, conventionally, a thermal printing has been utilized in printing on a relatively small printing target, in which the printing is achieved by placing a carbon ribbon over a printing surface and moving a printing head over the carbon ribbon to thermally print desired patterns on the printing surface.

However, such a conventional method of thermal printing is known to be associated with the following drawbacks, which have severely limited a practical implementation of an apparatus for thermal printing as well as its range of applicability.

First of all, in the conventional thermal printing, both the imprinting on the carbon ribbon as well as the transfer of the imprinted printing pattern are carried out at the same printing position, it has been difficult to apply such a conventional thermal printing to a printing of diverse patterns such as a printing of bar codes, on variety of not necessarily sufficiently flat printing surface such as that of a cardboard, wood, concrete, or steel sheet.

Secondly, in a conventional thermal printing apparatus, it has been structurally impossible to print patterns with a part of patterns left blank, where the blank part is to be printed at later time by a separate means such as a handy type printer for example.

Thirdly, in a conventional apparatus for thermal printing, both the imprinting of patterns on the carbon ribbon by the printing head and the thermal transfer of the patterns from the carbon ribbon to the printing surface take place at the same printing position, so that a stability of the printing head with respect to the printing surface is a crucial factor for the realization of a high precision printing. However, in a case of printing such printing target as a cardboard, the printing head has conventionally been supported by a bridge structure bridging over the printing surface, but such a bridge structure is known to be not stable enough to obtain a sufficient stability for the realization of the high precision thermal printing of patterns such as bar codes which require a very high level of precision.

SUMMARY OF THE INVENTION

It is therefore an object of the present invention to provide a method and an apparatus for high precision thermal printing capable of thermally printing diverse patterns on variety of printing targets having not necessarily sufficiently flat printing surfaces, stably and efficiently, at a very high precision.

According to one aspect of the present invention there is provided an apparatus for thermal printing, comprising: first film means for carrying a thermally transferrable applied material; second film means for receiving the applied material thermally transferred from the first film means; printing pattern formation means for forming a desired printing pattern on the second film means by applying heat to a desired part of the applied material on the first film means in a shape of the desired printing pattern; and thermal transfer means for thermally transferring the desired printing pattern formed on the second film means to a printing target.

According to another aspect of the present invention there is provided an method of thermal printing, comprising the steps of: providing first film means for carrying a thermally transferrable applied material; providing second film means for receiving the applied material thermally transferred from the first film means; forming a desired printing pattern on the second film means by applying heat to a desired part of the applied material on the first film means in a shape of the desired printing pattern; and thermally transferring the desired printing pattern formed on the second film means to a printing target.

Other features and advantages of the present invention will become apparent from the following description taken in conjunction with the accompanying drawings.

DETAILED DESCRIPTION OF THE PREFERRED EMBODIMENTS

Figure 1:
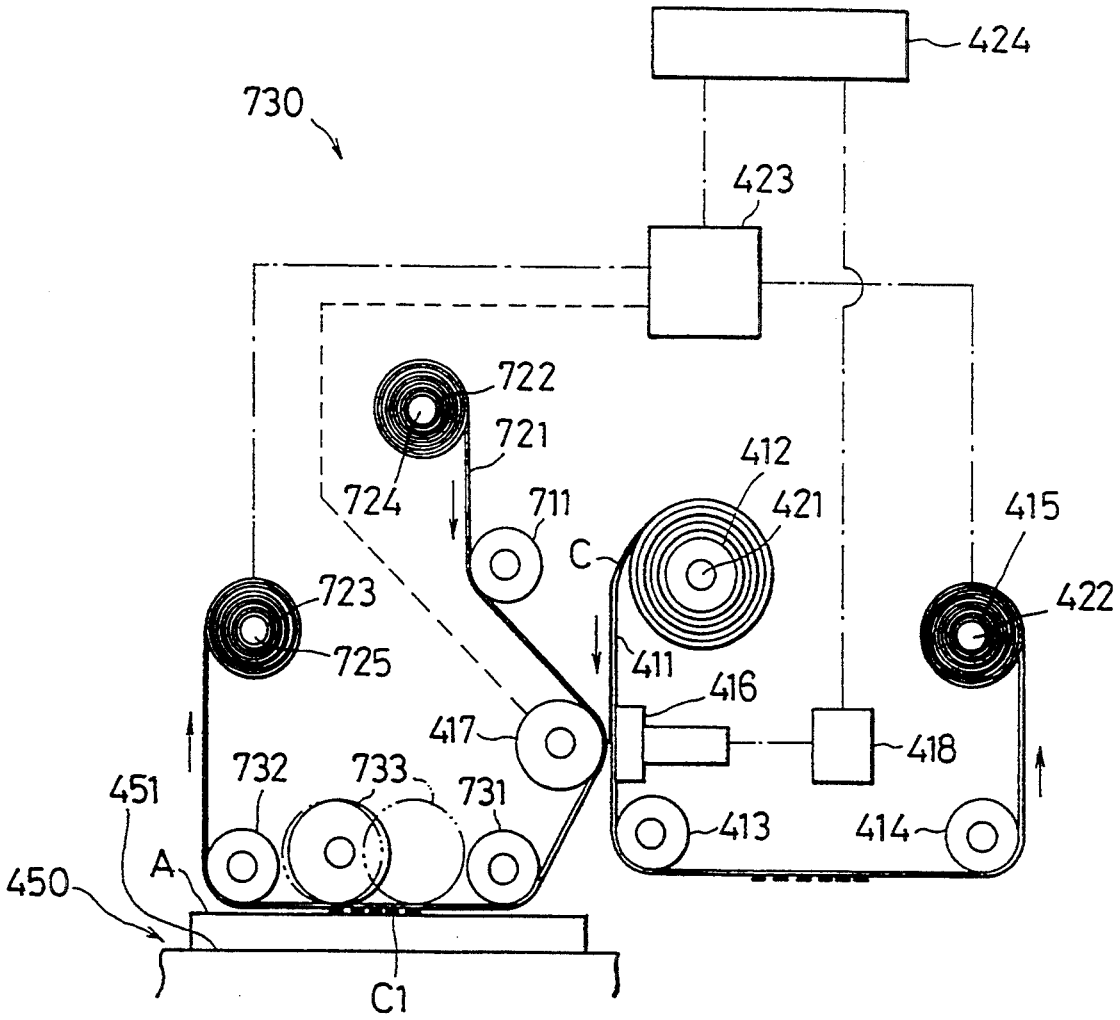
FIG. 1 is a schematic diagram of a first embodiment of an apparatus for high precision thermal printing according to the present invention.

Referring now to FIG. 1, a first embodiment of an apparatus for high precision thermal printing according to the present invention will be described in detail.

In this first embodiment, as shown in FIG. 1, a high precision thermal printing apparatus 730 makes a thermal printing on a plate shaped printing target A placed on a surface 451 of a printing target support member 450.

In this high precision thermal printing apparatus 730, there is provided a first film 411 having a carbon C (which is a typical example of an applied material in general) that is transferrable by an application of heat on a front side. This first film 411 is rolled around a cartridge type first roll out reel 412 detachably attached to a first roll out shaft 421. The first film 411 rolled out from the first roll out reel 412 is guided vertically downwards first and then turned to be horizontal by a guide roller 413, and guided vertically upwards by a guide roller 414, and then rolled up by a first roll up reel 415 detachably attached to a motor driven first roll up shaft 422. The first roll up shaft 422 is motor driven under the control by a motor control unit 423, which in turn is operated under the control of a central control unit 424 for controlling the operation of this high precision thermal printing apparatus as a whole.

Also, between the first roll out reel 412 and the guide roller 413, there is provided a printing head 416 along a back side of the first film 411, while on the front side of the first film 411, there is provided a motor driven platen roller 417 for supporting the first film 411 against the printing head 416 at a position facing against the printing head 416 across a part of the first film 411 that is guided vertically downwards. The platen roller 417 is motor driven under the control by the motor control unit 423.

The printing head 416 has a multiplicity of dot shaped heating resistors, and connected to a printing control unit 418 for controlling the current flow through each of the multiplicity of the heating resistors of the printing head 416 so as to apply appropriate heat to the first film 411 such that a part of the carbon C on the first film 411 in a shape of a desired printing pattern can be transferred from the first film 411. The printing control unit 418 is operated under the control of the central control unit 424.

The part of the carbon C transferred from the first film 411 is then imprinted onto an originally transparent second film 721 which is inserted between the front side of the first film 411 and the platen roller 417. In this first embodiment, only the necessary part of the carbon C in a shape of a desired printing pattern is imprinted on the second film 721 while the remaining unnecessary part of the carbon C are left on the first film 411. As a result, a desired positive (pattern blackened) printing pattern C1 can be formed on the second film 721 by the transferred part of the carbon C.

Here, it is apparently possible to form a desired printing pattern to be a negative (background blackened) one, if desired, by reversing the part to be transferred to the second film 721 and the part to be left on the first film 411.

It is also to be noted that, in order to obtain the positive (pattern blackened) printed letters on the plate shaped printing target A in a usual letter form, it is necessary for the desired printing pattern C1 formed on the second film 721 to be in a mirror image shape of the usual letter form under the control by the printing control unit 418. On the other hand, if it is desired to obtain the blackened printed letters on the plate shaped printing target A in a mirror image shape of the usual letter form under the control by the printing control unit 418.

The second film 721 is rolled around a cartridge type second roll out reel 722 detachably attached to a second roll out shaft 724. The second film 721 rolled out from the second roll out reel 722 is guided downwards first, inserted between the front side of the first film 411 and the platen roller 417, and turned to be horizontal next so as to have the desired printing pattern C1 formed thereon to be facing toward the plate shaped printing target A placed on the surface 451 of the printing target support member 450, by guide rollers 711 and 731, and then guided vertically upwards by a guide roller 732 and rolled up by a second roll up reel 723 detachably attached to a motor driven second roll up shaft 725. The second roll up shaft 725 is motor driven under the control by the motor control unit 423, which in turn is operated under the control of the central control unit 424. Here, the motor control unit 423 controls the first roll up shaft 422 and the second roll up shaft 725 such that the first film 411 and the second film 721 are rolled out at the identical constant roll out speed.

Also, between the guide rollers 731 and 732 at which the second film 721 is turned to be horizontal so as to have the desired printing pattern C1 formed thereon to be facing toward the plate shaped printing target A placed on the surface 451 of the printing target support member 450, there is provided a transfer roller 733 which is horizontally movable along a back side of the second film 721 as well as vertically movable with respect to the second film 721, such that it can thermally transfer the desired printing pattern C1 imprinted on the second film 721 to the plate shaped printing target A by heating the second film 721 while pressing the second film 721 against the plate shaped printing target A by the horizontal and vertical movements such that the desired positive printing pattern C1 can be printed on the surface of the plate shaped printing target A.

The second film 721 passed below the transfer roller 733 is subsequently rolled up by the second roll up reel 723, while the first film 411 passing through the printing head 416 which has the unnecessary part of the carbon C remaining thereon is subsequently rolled up by the first roll up reel 415. When the first and second films 411 and 721 are rolled out completely from the first and second roll out reels 412 and 722 and rolled up completely by the first and second roll up reels 415 and 723, the first and second roll out reels 412 and 722 as well as the first and second roll up reels 415 and 723 are replaced by new ones. Here, as the first and second films 411 and 721 are rolled up by the first and second roll up reels 415 and 723 in synchronization, it is possible to replace the first and second roll out reels 412 and 722 as well as the first and second roll up reels 415 and 723 all at once at the same timing, so that the interruption of the printing process due to the replacement of these reels can be reduced to the absolute minimum.

According to this first embodiment, the desired printing pattern C1 is formed by the thermal transfer on the second film 721 facing against the front side of the first film 411 having the applied material that can be transferred by the application of heat, so that a desirably complicated and fine printing pattern can be formed on the second film 721. Moreover, this desired printing pattern formed on the second film 721 is then printed on the plate shaped printing target A by the thermal transfer using the transfer roller 733 which heats and presses the second film 721 against the plate shaped printing target A, so that the desirably complicated and fine printing pattern can be printed at a high precision on the plate shaped printing target A, exactly as it is formed on the second film 721, even when the plate shaped printing target has uneven printing surface incorporating bending or curving parts.

Also, in this first embodiment, because the position of the printing head 416 at which the desired printing pattern C1 is imprinted onto the second film 721 and the position of the transfer roller 733 at which the desired printing pattern C1 formed on the second film 721 is thermally transferred to the plate shaped printing target A are spatially separated from each other, so that the desired printing pattern C1 can be formed continuously by the printing head 416 for a considerable length and such a considerably long desired printing pattern C1 can be printed onto the plate shaped printing target A at a high precision.

In addition, by using the printing target support member 450 having a sufficient strength, the thermal transfer by the transfer roller 733 can be carried out stably, even when the plate shaped printing target A has a large size, so that it becomes possible to obtain a sufficient stability for the realization of the high precision thermal printing of patterns such as bar codes which require a very high level of precision.

Furthermore, in this first embodiment, because the thermal transfer of the desired printing pattern C1 onto the plate shaped printing target A takes place at the transfer roller 733 located on the second film 721 side rather than the first film 411 side, the printing head 416 is required to thermally transfer only the necessary part of the carbon C in a shape of a desired printing pattern which usually occupies much smaller area than the unnecessary part of the carbon C in a case of the much common positive (pattern blackened) printing, so that there is no danger for the printing head 416 to be overheated, even when the desired printing pattern is a considerably large one.

Also, in this first embodiment, the printing head 416 does not contact with the printing surface of the plate shaped printing target A directly, so that there is no need to make any special protection for the logical circuits used in the printing head 416 against the damage due to the contact with the hard printing surface.

Figure 2:
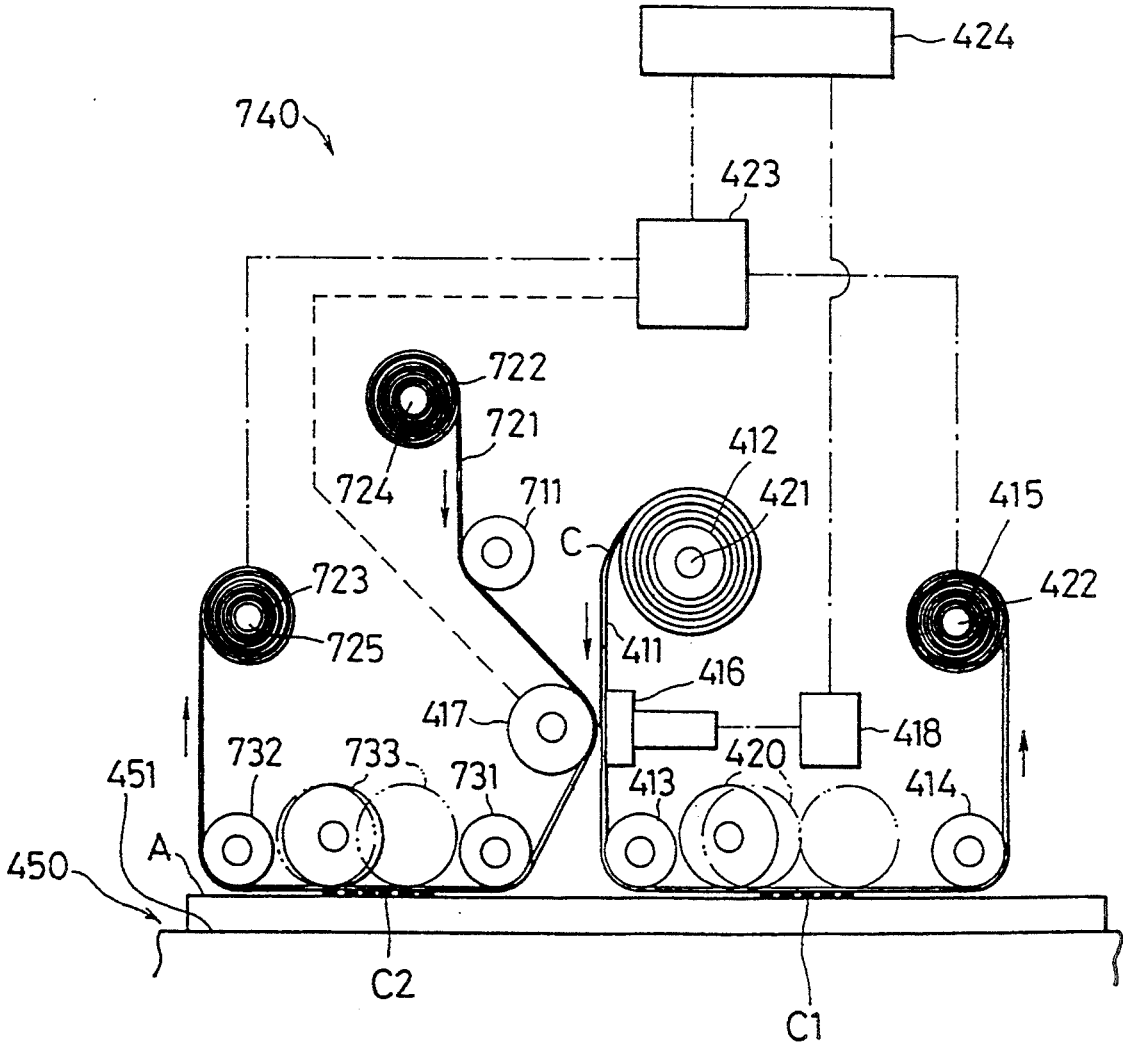
FIG. 2 is a schematic diagram of a second embodiment of an apparatus for high precision thermal printing according to the present invention.

Referring now to FIG. 2, a second embodiment of an apparatus for high precision thermal printing according to the present invention will be described in detail. Here, those elements which are substantially equivalent to corresponding elements in the first embodiment described above are given the same reference numerals in the figure and their description will not be repeated.

The high precision thermal printing apparatus 740 of this second embodiment differs from that of the first embodiment described above in that, as shown in FIG. 2, the printing is carried out at the first film 411 side as well as the second film 721 side. Namely, in this second embodiment, a desired positive (pattern blackened) printing pattern C1 is formed on the first film 411, while a negative (background blackened) desired printing pattern C2 is formed on the second film 721.

In order to carry out the thermal transfer of the desired positive printing pattern C1 formed on the first film 411, there is also provided a transfer roller 420 between the guide rollers 413 and 414 at which the first film 411 is turned to be horizontal so as to have the desired printing pattern C1 formed thereon to be facing toward the plate shaped printing target A placed on the surface 451 of the printing target support member 450 located below.

This transfer roller 420 is horizontally movable along a back side of the first film 411 as well as vertically movable with respect to the first film 411, such that it can thermally transfer the desired printing pattern C1 imprinted on the first film 411 to the plate shaped printing target A by heating the first film 411 while pressing the first film 411 against the plate shaped printing target A by the horizontal and vertical movements such that the desired positive printing pattern C1 can be printed on the surface of the plate shaped printing target A, while the transfer roller 733 thermally transfers the desired negative printing pattern C2 imprinted on the second film 721 to the plate shaped printing target A by heating and pressing the second film 721 against the plate shaped printing target A such that the desired negative printing pattern C2 can be printed on the surface of the plate shaped printing target A.

The rest of the configuration of this second embodiment is substantially similar to that of the first embodiment described above.

It is possible for this second embodiment to achieve the same advantageous effects as described above for the first embodiment.

Figure 3:
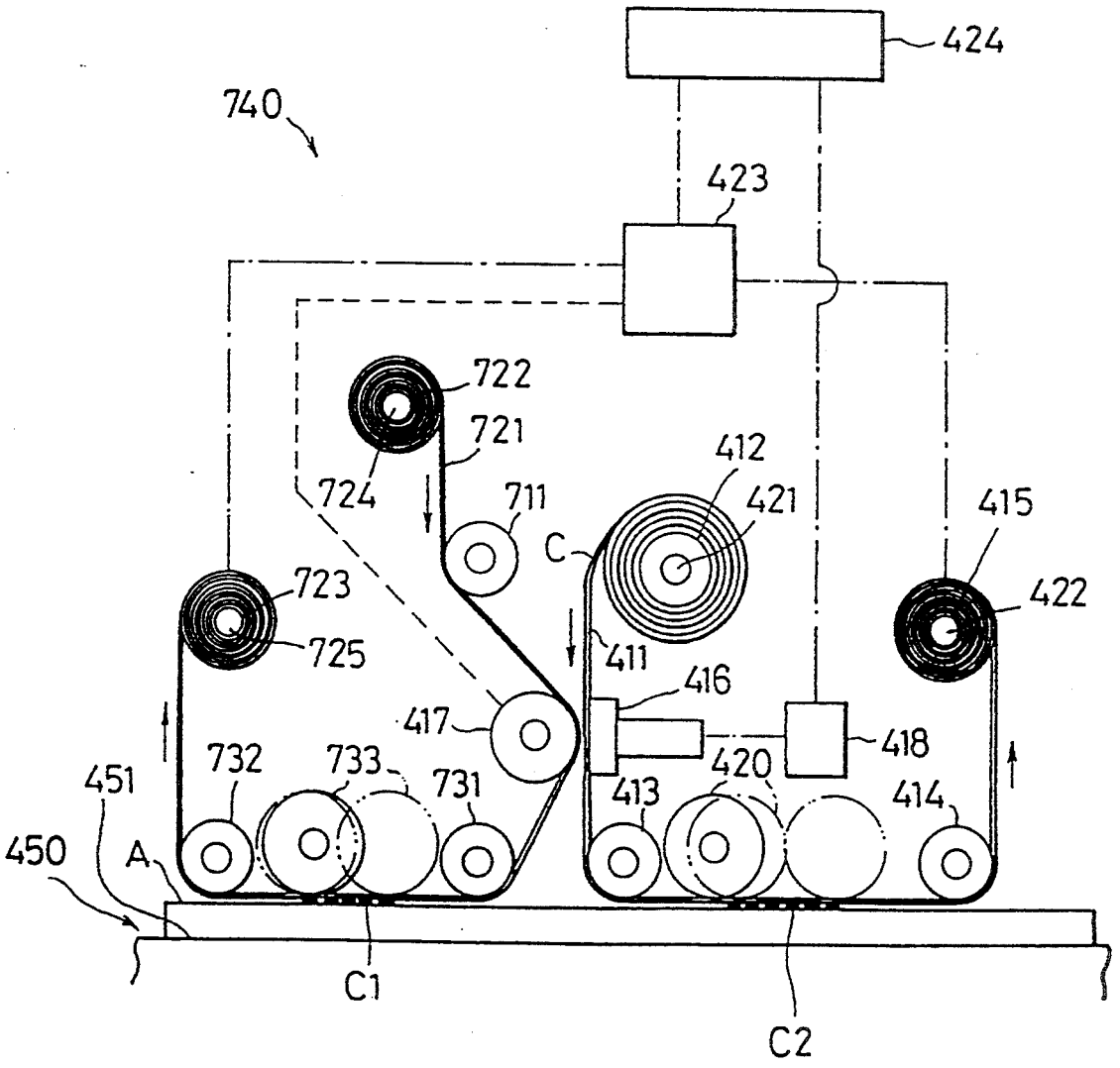
FIG. 3 is a schematic diagram of a third embodiment of an apparatus for high precision thermal printing according to the present invention.

Referring now to FIG. 3, a third embodiment of an apparatus for high precision thermal printing according to the present invention will be described in detail. Here, those elements which are substantially equivalent to corresponding elements in the second embodiment described above are given the same reference numerals in the figure and their description will not be repeated.

This third embodiment differs from the second embodiment described above in that, as shown in FIG. 3, in contrast to the second embodiment, the desired positive (pattern blackened) printing pattern C1 is formed on the second film 721, while the negative (background blackened) desired printing pattern C2 is formed on the first film 411.

The configuration of the high precision thermal printing apparatus 740 of this third embodiment is substantially equivalent to that of the second embodiment described above.

It is possible for this third embodiment to achieve the same advantageous effects as described above for the first embodiment.

Figure 4:
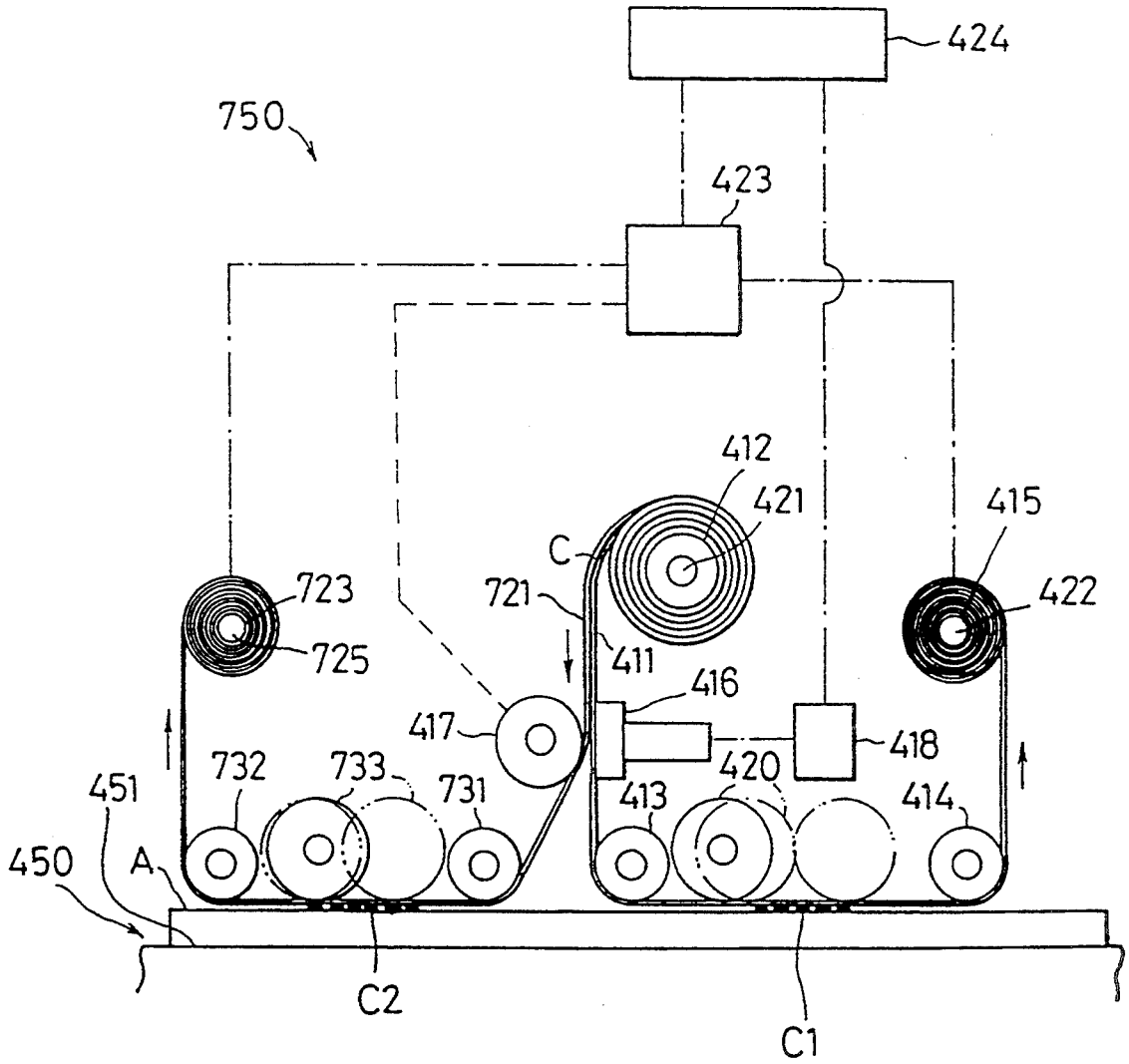
FIG. 4 is a schematic diagram of a fourth embodiment of an apparatus for high precision thermal printing according to the present invention.

Referring now to FIG. 4, a fourth embodiment of an apparatus for high precision thermal printing according to the present invention will be described in detail. Here, those elements which are substantially equivalent to corresponding elements in the second embodiment described above are given the same reference numerals in the figure and their description will not be repeated.

The high precision thermal printing apparatus 750 of this fourth embodiment differs from that of the previous embodiments described above in that, as shown in FIG. 4, the first film 411 and the second film 721 are rolled together around the first roll out reel 412, and separated apart from each other after the imprinting of the second film 721 is carried out as the commonly rolled first and second films 411 and 721 passes the printing head 416. Here, as in the second embodiment described above, the desired positive (pattern blackened) printing pattern C1 is formed on the first film 411, while the negative (background blackened) desired printing pattern C2 is formed on the second film 721. It is apparently also possible to form the desired positive (pattern blackened) printing pattern C1 on the second film 721, while forming the negative (background blackened) desired printing pattern C2 on the first film 411, as in the third embodiment described above. It is also apparently possible to carry out the printing only on the second film 721 side alone, as in the first embodiment described above.

The configuration of this fourth embodiment is substantially similar to that of the second embodiment described above, except that the second roll out reel 722 and the guide roller 711 provided on the second film 721 side are obviously unnecessary in this fourth embodiment.

It is possible for this fourth embodiment to achieve the same advantageous effects as described above for the first embodiment.

It is to be noted here that, the high precision thermal printing apparatus of any one of the embodiments described above can be constructed to be in a handy type rather than a fixed type as described above, such that the printing of a blank part of pre-printed patterns can easily be furnished at a later time by using such an apparatus formed in a handy type.

It is also to be noted that, in any one of the embodiments described above, the printing head 416 and the printing controller unit 418 may be combined into a single controllable printing head.

It is also to be noted that it is possible to provide the high precision thermal printing apparatus of any one of the embodiments described above in any desired orientation. In particular, it can be oriented sideways with respect to the vertically erected plate shaped printing target A, in which case the printing can be carried out very efficiently in a manner substantially similar to that of labelling, without a trouble of ink dripping that would have resulted when a conventional stamp printer is used in this manner.

Furthermore, by measuring the size of the plate shaped printing target A before the printing process, and providing the measured size of the plate shaped printing target A to the central control unit 424, it becomes possible for the central control unit 424 to automatically judge the desired printing pattern to be printed as well as the appropriate printing position on the plate shaped printing target A according to the prescribed printing data for each plate shaped printing target A, and to automatically control the printing control unit 418 and the printing position adjustment mechanism (not shown) accordingly, such that the printing process for printing diverse printing patterns predetermined according to the size and the type of the printing target on a large number of the printing targets can be carried out continuously, without any significant interruption of the printing process at a time of changing the printing pattern. In this case, the precision and the efficiency in the printing process can be improved simultaneously. The measurement of the size of the plate shaped printing target A can be made by a printing target conveying apparatus linked with the high precision thermal printing apparatus of the present invention, which measures the size of the plate shaped printing target A while conveying and placing the plate shaped printing target A on the printing target support member 450.

Besides those already mentioned, many modifications and variations of the above embodiments may be made without departing from the novel and advantageous features of the present invention. Accordingly, all such modifications and variations are intended to be included within the scope of the appended claims.

What is claimed is:

1. An apparatus for thermal printing, comprising:

first film means for carrying a thermally transferrable applied material;

second film means for receiving the applied material thermally transferred from the first film means;

printing pattern formation means for forming a desired printing pattern on the second film means by applying heat to a desired part of the applied material on the first film means in a shape of the desired printing pattern, while leaving a remaining part of the applied material not transferred by the application of heat to the first film means; and thermal transfer means for thermally transferring the desired printing pattern formed on the second film means to a printing target, and thermally transferring the remaining part of the applied material on the first film means to the printing target.

2. The apparatus of claim 1, wherein the desired printing pattern formed on the second film means is a negative printing pattern resulting from an application of the heat to the desired part of the applied material on the first film means in a shape of the negative printing pattern.

3. The apparatus of claim 2, wherein the application of the heat leaves a positive printing pattern on the first film means by a remaining part of the applied material not transferred by the application of the heat, and the thermal transfer means also thermally transfers the positive printing pattern on the first film means to the printing target while thermally transferring the negative printing pattern on the second film means to the printing target.

4. The apparatus of claim 1, wherein the desired printing pattern formed on the second film means is a positive printing pattern resulting from an application of the heat to the desired part of the applied material on the first film means in a shape of the positive printing pattern.

5. The apparatus of claim 4, wherein the application of the heat leaves a negative printing pattern on the first film by a remaining part of tile applied material not transferred by the application of the heat, and the thermal transfer means also thermally transfers the negative printing pattern on the first film means to the printing target while thermally transferring the positive printing pattern on the second film means to the printing target.

6. The apparatus of claim 1, wherein the first film means and the second film means are originally rolled together and subsequently separated from each other after the desired printing pattern is formed on the second film means in a vicinity of the printing pattern formation means.

7. The apparatus of claim 1, wherein the printing pattern formation means further comprises:

printing head means located along one side of the first film means on which the applied material is not applied, for applying the heat to the first film means; and platen roller means located along another side of the first film means on which the applied material is applied, at a position facing against the printing head means across the first film means and the second film means, for supporting the first film means and the second film means against the printing head means.

8. The apparatus of claim 1, wherein the thermal transfer means comprises a transfer roller located along the second film means, for applying heat to the second film means while pressing the second film means against the printing target such that the desired printing pattern formed on the second film means is printed on the printing target.

9. The apparatus of claim 1, wherein the printing pattern formation means and the thermal transfer means are located at spatially separated positions.

10. The apparatus of claim 1, further comprising means for rolling out the first film means and the second film means at an identical roll out speed.

11. A method of thermal printing, comprising the steps of:

providing first film means for carrying a thermally transferrable applied material;

providing second film means for receiving the applied material thermally transferred from the first film means;

forming a desired printing pattern on the second film means by applying heat to a desired part of the applied material on the first film means in a shape of the desired printing pattern, while leaving a remaining part of the applied material not transferred by the application of heat to the first film means; and thermally transferring the desired printing pattern formed on the second film means to a printing target, and thermally transferring the remaining part of the applied material on the first film means to the printing target.

12. The method of claim 11, wherein at the forming step, the desired printing pattern formed on the second film means is a negative printing pattern resulting from an application of the heat to the desired part of the applied material on the first film means in a shape of the negative printing pattern.

13. The method of claim 12, wherein at the forming step, the application of the heat leaves a positive printing pattern on the first film means by a remaining part of the applied material not transferred by the application of the heat, and the thermally transferring step also thermally transfers the positive printing pattern on the first film means to the printing target while thermally transferring the negative printing pattern on the second film means to the printing target.

14. The method of claim 11, wherein at the forming step, the desired printing pattern formed on the second film means is a positive printing pattern resulting from an application of the heat to the desired part of the applied material on the first film means in a shape of the positive printing pattern.

15. The method of claim 14, wherein at the forming step, the application of the heat leaves a negative printing pattern on the first film by a remaining part of the applied material not transferred by the application of the heat, and the thermally transferring step also thermally transfers the negative printing pattern on the first film means to the printing target while thermally transferring the positive printing pattern on the second film means to the printing target.

16. The method of claim 11, wherein the first film means and the second film means are originally rolled together at the providing steps and subsequently separated from each other after the desired printing pattern is formed on the second film means, at the forming step in a vicinity of the printing pattern formation means.

17. The method of claim 11, wherein at the forming step, the desired printing pattern is formed by the steps of:

applying the heat to the first film means by printing head means located along one side of the first film means on which the applied material is not applied; and supporting the first film means and the second film means against the printing head means by platen roller means located along another side of the first film means on which the applied material is applied, at a position facing against the printing head means across the first film means and the second film means.

18. The method of claim 11, wherein at the thermally transferring step, the desired printing pattern is thermally transferred by a transfer roller located along the second film means, which applies heat to the second film means while pressing the second film means against the printing target such that the desired printing pattern formed on the second film means is printed on the printing target.

19. The method of claim 11, wherein a formation of the desired printing pattern at the forming step and a thermal transfer of the desired printing pattern at the thermally transferring step are carried out at spatially separated positions.

20. The method of claim 11, further comprising the step of rolling out the first film means and the second film means at an identical roll out speed.

* * * * *